US010034330B2

(12) United States Patent
Wyble et al.

(10) Patent No.: US 10,034,330 B2
(45) Date of Patent: Jul. 24, 2018

(54) SYSTEM AND METHOD FOR HEAT TREATING A TUBULAR

(71) Applicant: NATIONAL OILWELL VARCO, L.P., Houston, TX (US)

(72) Inventors: Kevin Joseph Wyble, Spring, TX (US); Daniel Lyle Hannahs, Houston, TX (US); Daryl Stevenson, Cypress, TX (US); Shawn Lee Cunningham, Pearland, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 1420 days.

(21) Appl. No.: 13/832,404

(22) Filed: Mar. 15, 2013

(65) Prior Publication Data

US 2014/0263284 A1 Sep. 18, 2014

(51) Int. Cl.

| | |
|---|---|
| ***H05B 6/36*** | (2006.01) |
| ***H05B 6/06*** | (2006.01) |
| ***H05B 6/10*** | (2006.01) |
| ***H05B 6/38*** | (2006.01) |

(52) U.S. Cl.

CPC ..... *H05B 6/06* (2013.01); *H05B 6/101* (2013.01); *H05B 6/38* (2013.01)

(58) Field of Classification Search

CPC ..... B23K 13/02; B21C 29/00; H05B 6/42; H05B 6/04

USPC ..... 219/613, 609, 632, 674, 640, 641, 642, 219/643, 644, 660, 661, 667

See application file for complete search history.

(56) References Cited

U.S. PATENT DOCUMENTS 2,528,810 A * 11/1950 Van Zeeland ..... B23K 13/00 219/607
2,788,426 A * 4/1957 Thompson ..... H05B 6/04 219/660
2,947,841 A * 8/1960 Pickles ..... H01Q 1/02 219/628
3,652,968 A * 3/1972 Johnston ..... H01F 27/325 29/605
3,958,328 A * 5/1976 Lee ..... H01F 27/2823 242/118.41
4,418,258 A * 11/1983 McNealy ..... C21D 1/42 148/526
4,549,130 A * 10/1985 Dobberstein ..... H01F 19/04 323/308
4,584,453 A * 4/1986 Fu ..... B23K 13/00 219/608
4,585,917 A * 4/1986 Yoshida ..... B23K 9/048 219/59.1

(Continued)

FOREIGN PATENT DOCUMENTS

EP 2441849 A2 4/2012

OTHER PUBLICATIONS

European Patent Application No. 14160104.7 Search Report and Search Opinion dated Jun. 24, 2014 (6 pages).

*Primary Examiner* — Jimmy Chou

(57) ABSTRACT

A system and method for heat treating a tubular. In one embodiment, a system for heat treating a tubular includes a first coil and a second coil. The first coil is configured to circumferentially surround the tubular and induce, from without the tubular, current flow in a cylindrical portion of the tubular adjacent the first coil. The second coil is configured to be inserted into a bore of the tubular and induce, from within the tubular, in conjunction with the first coil, current flow in the cylindrical portion of the tubular.

14 Claims, 3 Drawing Sheets

(56) References Cited

U.S. PATENT DOCUMENTS 4,675,488 A * 6/1987 Mucha ..... C21D 9/32 219/640
4,757,170 A * 7/1988 Mucha ..... C21D 9/32 219/640
4,812,052 A * 3/1989 Adam ..... G01N 3/18 219/634
4,855,556 A * 8/1989 Mucha ..... C21D 9/32 219/640
4,894,501 A * 1/1990 Pfaffmann ..... C21D 1/10 219/640
5,272,719 A * 12/1993 Cartlidge ..... F27B 14/061 219/662
5,523,550 A * 6/1996 Kimura ..... F24H 1/101 219/628
5,571,437 A * 11/1996 Rudd ..... B23K 13/025 219/607
6,429,619 B2 * 8/2002 Denise ..... H02P 8/14 318/696
6,753,515 B2 * 6/2004 Miyahara ..... G03G 15/2053 219/619
6,946,629 B2 * 9/2005 Miyahara ..... G03G 15/2053 219/619
9,158,866 B2 * 10/2015 Sato ..... G06F 17/50
2004/0149734 A1 * 8/2004 Petrenko ..... B60S 1/026 219/538
2006/0091136 A1 5/2006 Weiss
2007/0108195 A1 * 5/2007 Tian ..... B23K 13/01 219/702
2010/0147831 A1 * 6/2010 Minoue ..... H05B 6/06 219/600
2011/0248024 A1 * 10/2011 Yonenaga ..... H01L 21/67109 219/634
2011/0253702 A1 * 10/2011 Regan ..... B23K 9/235 219/482

* cited by examiner

SYSTEM AND METHOD FOR HEAT TREATING A TUBULAR

BACKGROUND

The fabrication and manufacture of goods from metals often results in the metals having a less than desirable metallurgical condition. To convert the metals to a desired condition, it is common to heat treat the metals. In heat treating, an object, or portion thereof, is heated to a suitably high temperature and subsequently cooled to ambient temperature. The temperature to which the metal is heated, the time of heating, as well as the rate of cooling, may be selected to develop the intended physical properties in the metal. For example, for normalization, steel is to be heated to a temperature above the critical range, to about 1600 degrees Fahrenheit and then cooled slowly, while tempering of steel also requires uniformly heating to a temperature below the critical range to a specified temperature, holding at that temperature for a designated time period then cooling in air or liquid.

Inductive heating is one method for producing heat in a localized area of a metallic object. In inductive heating, an alternating current electric signal is provided to a coil disposed near a selected location of the metallic object to be heated. The alternating current in the coil creates a varying magnetic flux within the metal to be heated. The magnetic flux induces current flow in the in the metal, which, in turn, heats the metal.

SUMMARY

A system and method for heat treating a tubular are disclosed herein. In one embodiment, a system for heat treating a tubular includes a first coil and a second coil. The first coil is configured to circumferentially surround the tubular and induce, from without the tubular, current flow in a cylindrical portion of the tubular adjacent the first coil. The second coil is configured to be inserted into a bore of the tubular and induce, from within the tubular, in conjunction with the first coil, current flow in the cylindrical portion of the tubular.

In another embodiment, a method for heat treating a tubular includes positioning a first coil to encircle a portion of a tubular to be heat treated. A second coil is positioned within a bore of the tubular at a location of the portion of the tubular to be heat treated. The portion of the tubular is heat treated by inducing current flow about an exterior cylindrical wall and an interior cylindrical wall of the portion of the tubular via the first coil and the second coil.

In a further embodiment, inductive heat treatment apparatus includes an exterior induction coil, an interior induction coil, and a controller coupled to the exterior induction coil and the interior induction coil. The exterior induction coil is configured to surround an outside diameter of a tubular. The interior induction coil is configured to occupy a bore of the tubular. The controller is configured to simultaneously energize the exterior induction coil and the interior induction coil to concurrently heat treat a selected cylindrical portion of the tubular from exterior and interior of the tubular.

BRIEF DESCRIPTION OF THE DRAWINGS

For a detailed description of exemplary embodiments of the invention, reference is now be made to the figures of the accompanying drawings. The figures are not necessarily to scale, and certain features and certain views of the figures may be shown exaggerated in scale or in schematic form, and some details of conventional elements may not be shown in the interest of clarity and conciseness.

NOTATION AND NOMENCLATURE

Figure 1:
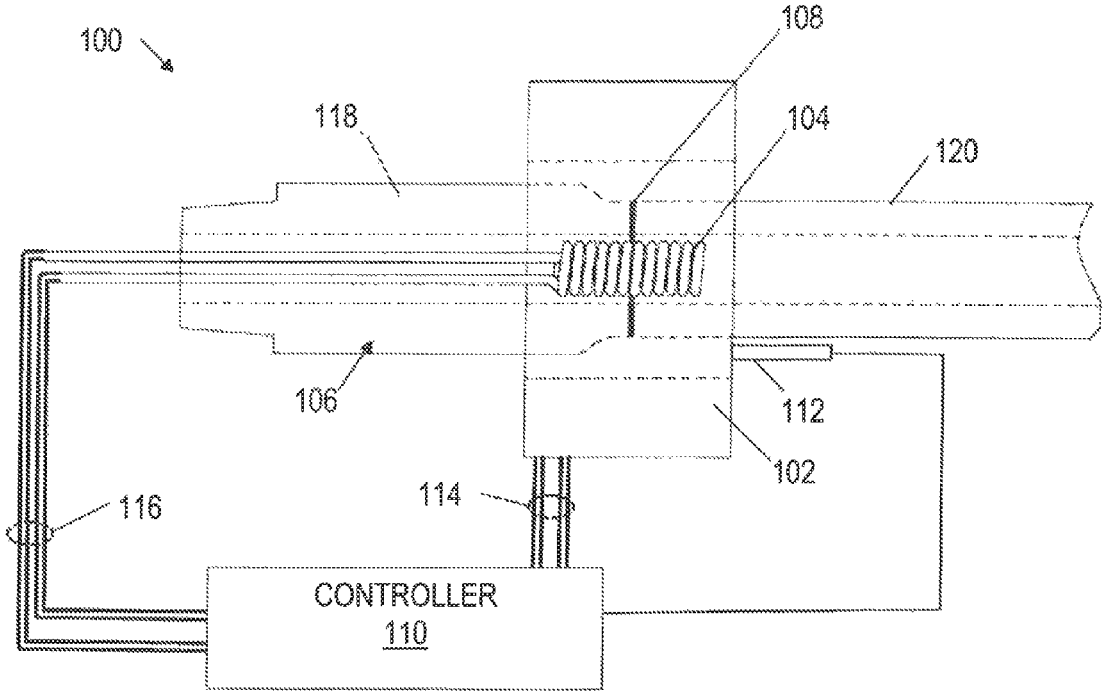
FIG. 1 shows a schematic diagram of a system for heat treating a tubular in accordance with principles disclosed herein.

Certain terms are used throughout the following description and claims to refer to particular system components. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through direct engagement of the devices or through an indirect connection via other intermediate devices and connections. Further, the term "software" includes any executable code capable of running on a processor, regardless of the media used to store the software. Thus, code stored in memory (e.g., non-volatile memory), and sometimes referred to as "embedded firmware," is included within the definition of software. The recitation "based on" is intended to mean "based at least in part on." Therefore, if X is based on Y, X may be based on Y and any number of other factors. The term "approximately" means within plus or minus 10 percent of a stated value.

DETAILED DESCRIPTION

In the drawings and description that follow, like parts are typically marked throughout the specification and drawings with the same reference numerals. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings and components of the embodiments discussed below may be employed separately or in any suitable combination to produce desired results.

In manufacture of tubulars, such as those employed in drilling of subsurface formations (e.g., tubulars used in a drill string), heat treating may be applied to improve the metallurgical characteristics of selected portions of the portions of the tubular. For example, portions of the tubular along weld lines may be heat treated to relieve internal stresses caused by the welding.

In conventional post-weld heat treating of drill string tubulars, a selected portion of the wall of the tubular is heated from one side (e.g., heat is induced from the outer surface of the tubular) and the metal of the tubular conducts the heat to the opposing side of the tubular wall. When examined metallurgically, such heating (heating via an induction coil disposed about the outer diameter (OD) of the tubular) may produce a heat affected zone that is substantially wider at the OD of the tubular wall than at the inner diameter (ID) of the tubular wall. Such heat treating may be difficult to control. If the heat treatment is too shallow, less than the entire thickness of the tubular wall may be heat treated. If the heat treatment is too deep, the length of the heat treated region (along the tubular) may be greater than desired.

Embodiments of the present disclosure include a system for heat treating a tubular that simultaneously provides inductive heating about 360 degrees of the outer and inner surfaces of a tubular. By providing inductive heating from both the exterior and the interior of a tubular, embodiments provide a better controlled heat treatment with a narrower heat affected zone, resulting in higher product quality. Additionally, by heating from both without and within, embodiments reduce the time required to heat treat the tubular, thereby improving manufacturing throughput and reducing overall production cost.

FIG. 1 shows a schematic diagram of a system 100 for heat treating a tubular 106 in accordance with principles disclosed herein. The system 100 includes a first induction coil 102, a second induction coil 104, a controller 110, and a pyrometer 112. The first induction coil 102 is positionable about the tubular 106, such the first induction coil 102 surrounds a cylindrical portion of the tubular 106, and is configured to inductively heat the cylindrical portion of the tubular 106 from the exterior. The second induction coil 104 is positionable within the inner bore of the tubular 106, and configured to inductively heat a cylindrical portion of the tubular 106 from the interior. Some embodiments of the coil 104 may be capable of inductively heating any selected portion of the tubular 106. Other embodiments of the coil 104 may be capable of inductively heating a portion of the tubular 106 at a location up to 48 inches from the end of the tubular 106.

In operation, the first and second inductive coils 102, 104 are positioned to inductively heat a same cylinder of the tubular 106. For example, in FIG. 1, the coils 102, 104 are centered on the weld line 108 joining segments 118 and 120 of the tubular 106. The tubular 206 may be, for example, a drill pipe, a drill collar, a downhole tool housing, or any other tubular employed in drilling or production of subsurface formations.

The coils 102, 104 may be generally toroidal in shape, and formed of one or more turns of copper tubing that provides a conductive path for current that energizes the coil, and a channel for pumping coolant through the coil. Each of the coils 102, 104 may be wrapped in a refractory material that provides a housing for the coil. In some embodiments, the coil 102 includes nine turns and the coil 104 includes eleven turns. The number of turns may differ in other embodiments of the coils 102, 104.

The controller 110 is coupled to coil 102 via tubing 114 that provides a path for current and cooling flow. Similarly, controller 110 is coupled to coil 104 via tubing 116. The controller 110 manages the operation of the coils 102, 104 to heat treat the tubular 106. More specifically, the controller 110 controls flow of alternating current (AC) to the coils 102, 104, thereby controlling the heating of the tubular 106. The pyrometer 112 is coupled to the controller 110. The pyrometer 112 measures the temperature of the portion of the tubular 106 heated by the system 100. In some embodiments, the pyrometer 112 is an optical pyrometer. The pyrometer 112 may be focused on the exterior surface of the tubular 106. The controller 110 may determine current values and/or heating intervals based on the temperature measurement values provided by the pyrometer 112. For example, if inductive heating has increased the temperature of the tubular 106 to a predetermined value, the controller 110 may set the current to the coils 102, 104 to maintain the tubular 106 at the attained temperature for a predetermined time interval.

Some embodiments of the controller 110 may include multiple sub-controllers that cooperatively control the coils 102, 104 to inductively heat a selected portion of the tubular 106. For example, a first sub-controller may manage operation of the coil 102 in cooperation with a second controller that manages operation of the coil 104.

Figure 2:
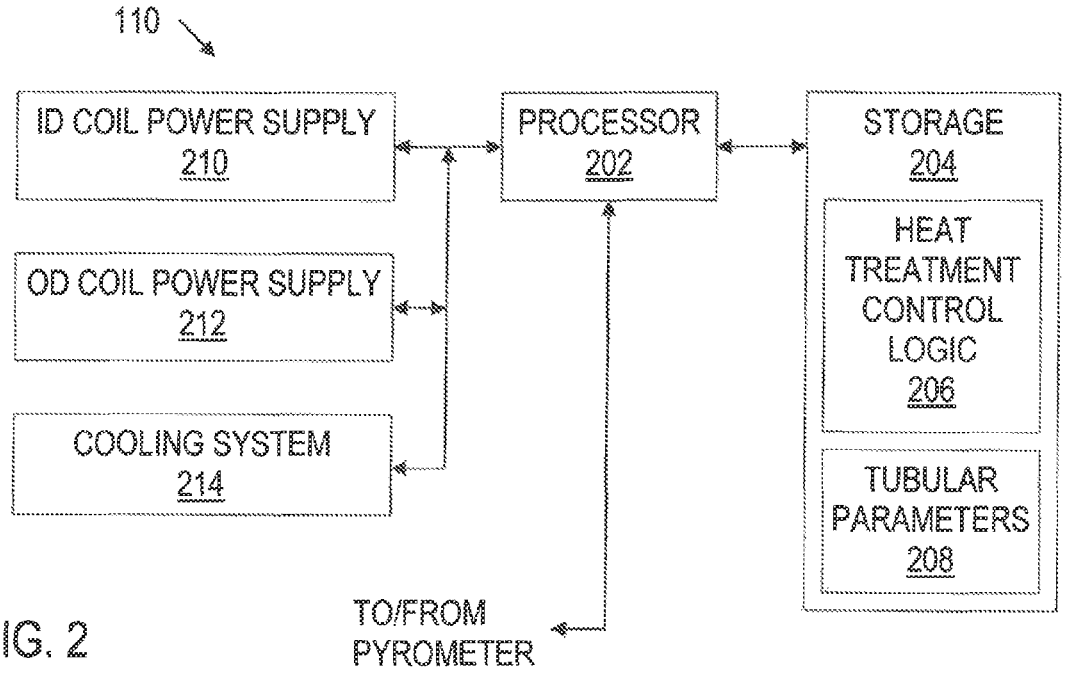
FIG. 2 shows a block diagram of a controller for managing heat treatment of a tubular in accordance with principles disclosed herein.

FIG. 2 shows a block diagram of the controller 110 in accordance with principles disclosed herein. The controller 110 includes a processor 202, storage 204, an ID coil power supply 210, an OD coil power supply 212, and a cooling system 214. The processor 202 is coupled to the ID coil power supply 210, the OD coil power supply 212, and the coil cooling system 214 to monitor and control the operation of the system 100. The controller 110 may also include various other components, such as display devices (e.g., a monitor), operator control devices (a keyboard, mouse, trackball, etc.), and/or other components that have been omitted from FIG. 2 in the interest of clarity. In some embodiments of the controller 110, the processor 202 and the storage 204 may be embodied in a programmable logic controller or other computing device.

The OD coil power supply 212 includes a solid-state high frequency power supply that provides power to the coil 102. Some embodiments of the power supply 212 may include integrated gate bipolar transistor (IGBT) drivers to provide current to the coil 102. The OD coil power supply 212 is controllable by the processor 202 to provide any of wide range of frequencies of AC to the coil 102, and to provide any of a specified power, current, and/or voltage to the coil 102. The OD coil power supply 212 may also be controllable by the processor 202 to sweep a range of frequencies for determination of a resonant frequency of the circuit comprising the coil 102 and the tubular 106. In some embodiments of the system 100, the OD coil power supply 212 is controllable by the processor 202 to provide approximately 180 hertz (Hz) AC and/or at least approximately 150 kilowatts of power to the coil 102.

The ID coil power supply 210 is similar in structure and operation to the OD coil power supply 212, and provides power to the coil 104. Like the OD coil power supply 212, the ID coil power supply 210 is controllable by the processor 202 to provide any of wide range of frequencies of AC to the coil 104, and to provide any of a specified power, current, and/or voltage to the coil 104. The ID coil power supply 210 may be controllable by the processor 202 to sweep a range of frequencies for determination of a resonant frequency of the circuit comprising the coil 104 and the tubular 106.

To avoid interference in the operation of the coils 102, 104, the ID coil power supply 210 may provide AC to the coil 104 at a substantially different frequency than the frequency at which AC is provided to the coil 102 by the OD coil power supply 212. For example, in some embodiments, the frequency of current provided to the coil 104 may be substantially higher than the frequency of current provided to the coil. 102. In some embodiments of the system 100, the ID coil power supply 210 is controllable by the processor 202 to provide AC to the coil 104 at a frequency in a range of from approximately 3 kilohertz (KHz) to approximately 10 KHz, and/or to provide at least approximately 125 kilowatts of power to the coil 104.

The cooling system 214 provides cooling to the coils 102, 104, and/or the power supplies 210, 212. In some embodiments, the cooling system 214 includes a water recirculating system that provides water cooling to the coils 102, 104, and/or the power supplies 210, 212. For example, the cooling system 214 may pump water through the copper tubing of the coils 102, 104. The cooling system 214 may provide approximately 90 gallons per minute water to cool the coils 102, 104, where the water temperature is no more than 90 degrees Fahrenheit and above the dew point.

The processor 202 is a device that executes instructions to manage the heat treatment of tubular 106. Suitable processors include, for example, general-purpose microprocessors, digital signal processors, and microcontrollers. Processor architectures generally include execution units (e.g., fixed point, floating point, integer, etc.), storage (e.g., registers, memory, etc.), instruction decoding, peripherals (e.g., interrupt controllers, timers, direct memory access controllers, etc.), input/output systems (e.g., serial ports, parallel ports, etc.) and various other components and sub-systems.

The storage 204 is a computer-readable storage device that stores instructions to be executed by the processor 202. When executed the instructions cause the processor 202 to perform the various heat treatment management operations disclosed herein. A computer readable storage device may include volatile storage such as random access memory, non-volatile storage (e.g., FLASH storage, read-only-memory, etc.), or combinations thereof. Instructions stored in the storage 204 may cause the processor 202 to enable flow of current to the coils 102, 104, control values of current, voltage, and/or power provided to the coils 102, 104, control coolant flow to the coils 102, 104, etc.

The storage 404 includes a heat treatment control logic module 206, and tubular parameters 208. The processor 202 executes instructions of the heat treatment control logic module 206 to manage heat treatment of the tubular 206. The tubular parameters 208 may include parameter values for heat treating a number of different tubulars (e.g., tubulars of different types, materials, wall thicknesses, etc.) The values of the tubular parameters 208 may be entered by an operator for future retrieval, and selected by the operator for application to a particular tubular. The parameter values may include minimum and/or maximum power levels for preheating and soaking, set point temperature of OD heating, etc.

The heat treatment control logic module 206 may control the heat treatment of the tubular 106 using a proportional-integral-derivative (PID) control loop, or other control methodology, with temperature feedback provided via the pyrometer 112. The processor 202, via execution of the heat treatment control logic module 206, controls the power provided to both of the coils 102, 104. For example, as the temperature of the exterior surface of the tubular 106 approaches or reaches a predetermined set point temperature during heat treatment, the processor 202 may reduce or disable current flow to the coils 102, 104.

Figure 3:
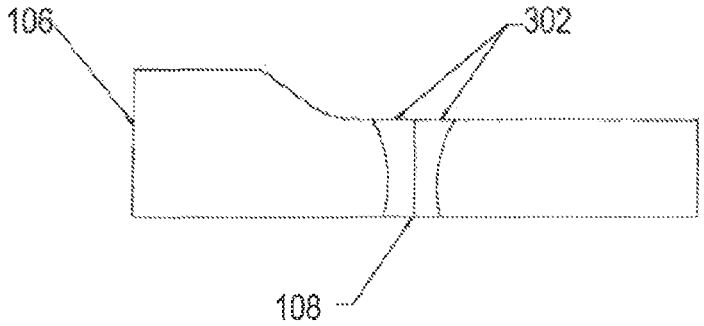
FIG. 3 shows a cross sectional view of a wall of a tubular heat treated in accordance with principles disclosed herein.

FIG. 3 shows a cross sectional view of a wall of the tubular 106 heat treated in accordance with principles disclosed herein. By heating the wall of the tubular 106 proximate the weld line 108 from both the outer and inner surfaces of the wall, the width of the heat affected zone 302 is reduced relative to application of inductive heating from a single surface of the tubular 106. Additionally, the system 100 provides a more uniform heat affected zone 302 than is provided using single coil inductive heating. As shown in FIG. 3, operation of the system 100 produces a heat treated zone 302 having a shallow parabolic outline with the vertex facing the weld line 108. In some embodiments, the vertex is located in a center third of the wall of the tubular 106 in accordance with the balanced heating provided by the coils 102, 104. Furthermore, the system 100 can produce the superior heat treatment result shown in FIG. 3 in significantly less time than would be required to produce an inferior result using a single coil.

Figure 4:
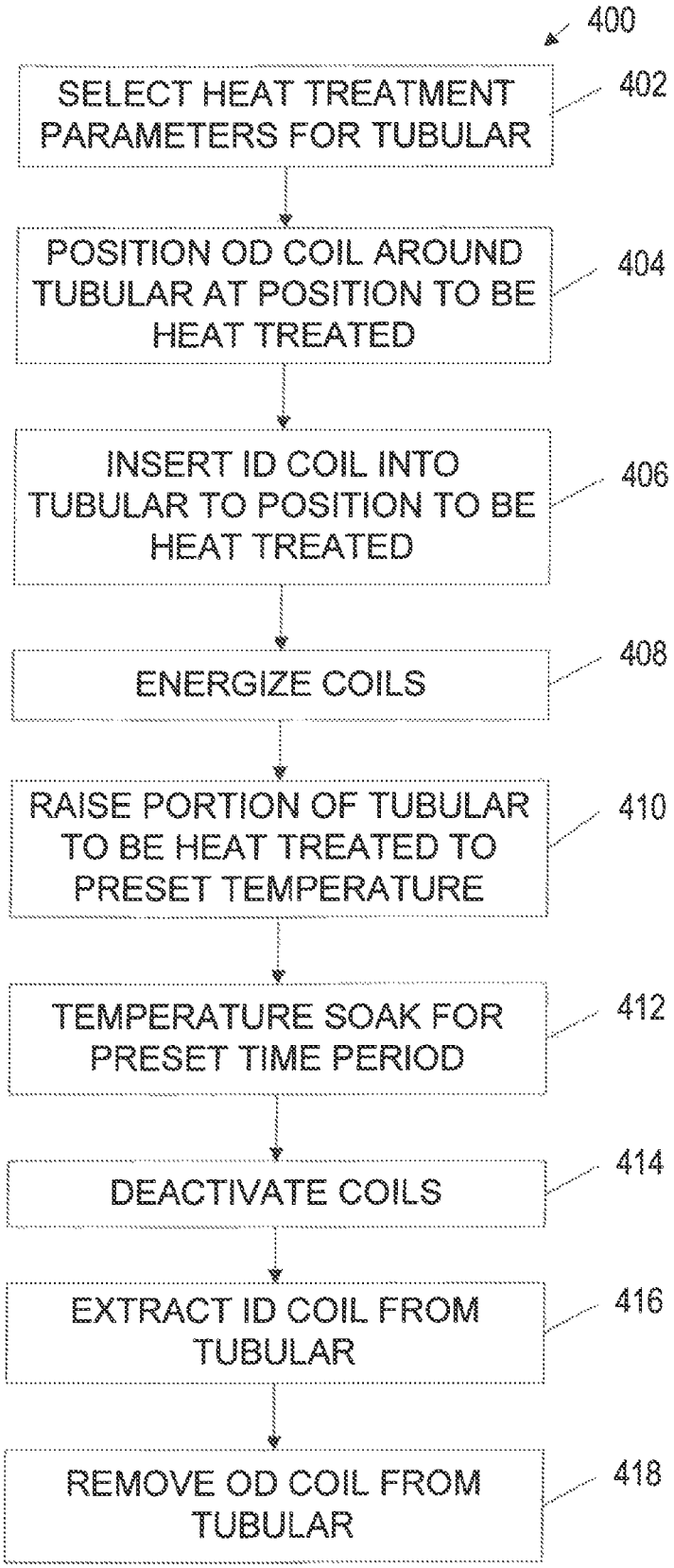
FIG. 4 shows a flow diagram for a method for heat treating a tubular in accordance with principles disclosed herein.

FIG. 4 shows a flow diagram for a method for heat treating a tubular in accordance with principles disclosed herein. Though depicted sequentially as a matter of convenience, at least some of the actions shown can be performed in a different order and/or performed in parallel. Additionally, some embodiments may perform only some of the actions shown. In some embodiments, at least some of the operations of the method 400, as well as other operations described herein, can be implemented as instructions stored in a computer readable storage device 204 and executed by the processor 202.

In block 402, parameter values to be applied to heat treatment of the tubular 106 are selected. In some embodiments, the parameter values for a number of different tubulars are stored in the storage device 204, and selected by identifying the tubular to be heat treated. For example, an operator of the system 100 may select a tubular to be heat treated via a user interface of the controller 110.

In block 404, the coil 102 is positioned around the outer diameter of the tubular 106. In some embodiments of the system 100, the coil 102 may stationary and the tubular 106 inserted into a central opening of the coil 102 such that the coil 102 surrounds the circumference of the tubular 106. In other embodiments, the coil 102 may be portable and moved into position about the tubular 106 such that the coil 102 completely surrounds the outer diameter of a portion or segment of the tubular 106 to be heat treated. For example, the coil 102 may be centered about the weld line 108.

In block 406, the coil 104 is inserted into an end of the tubular 106 to a location that is radially aligned with the coil 102. For example, both the coil 102 and the coil 104 may be centered on the weld line 108 for heat treating of the welded portion of the tubular 106.

In block 408, the controller energizes the coils 102, 104 by providing AC current to the coils 102, 104 at selected frequencies, power, voltage, and/or current levels. The frequency of current provided to the coil 104 may be higher than the frequency of current provided to the coil 102. For example, approximately 180 Hz AC may be provided to coil 102, and AC in a range of approximately 3 KHz to 10 KHz may be provided to coil 104. The energized coils 102, 104 inductively heat the tubular 106. For example, the coils 102, 104 may inductively heat a cylindrical portion of the tubular 106 to a temperature of 2000 degrees Fahrenheit or higher.

In block 410, the controller 110 is monitoring the temperature of the tubular 106 via the pyrometer 112. The controller 110 may continue to provide current to the coils 102, 104 at a level that increases the temperature of the portion of the tubular 106 being heat treated until the temperature of the tubular reaches or approaches a specified set point temperature for heat treatment of the tubular 106. The set point temperature may be provided as one of the parameter values selected in block 402.

In block 412, the controller 110 reduces current flow to the coils 102, 104 to a level that maintains the tubular 106 at the set point temperature, and allows the tubular 106 to temperature soak for a predetermined soak time period. The predetermined soak time period may be provided as one of the parameter values selected in block 402.

In block 414, the controller 110 deactivates the coils 102, 104 by disabling current flow to the coils 102, 104. The coil 104 is extracted from the bore of the tubular 106 in block 416, and the coil 102 is removed from around the tubular 106 in block 418.

The above discussion is meant to be illustrative of various embodiments of the present invention. Numerous variations and modifications will become apparent to those skilled in the art once the above disclosure is fully appreciated. It is intended that the following claims be interpreted to embrace all such variations and modifications.

What is claimed is:

1. A system for heat treating a tubular, comprising:

a first coil configured to circumferentially surround the tubular and induce, from an outside of the tubular, current flow in a cylindrical portion of the tubular adjacent the first coil;

a second coil configured to be inserted into a bore of the tubular and induce, from within the tubular, in conjunction with the first coil, current flow in the cylindrical portion of the tubular, wherein the first coil and the second coil are positioned to inductively heat the cylindrical portion of the tubular at the same time; and one or more controllers that control current flow to the first coil and the second coil for inducing current flow in the cylindrical portion of the tubular, the one or more controllers configured to:

provide alternating current to the first coil at a first frequency; and provide alternating current to the second coil at a second frequency while providing the alternating current to the first coil at the first frequency, wherein the first frequency is different from the second frequency.

2. The system of claim 1, wherein the second frequency is higher than the first frequency.

3. The system of claim 1, wherein the first frequency is approximately 180 hertz.

4. The system of claim 1, wherein the second frequency is in a range of approximately 3 kilohertz to approximately 10 kilohertz.

5. The system of claim 1, wherein the one or more controllers are configured to provide at least approximately 150 kilowatts of power to the first coil.

6. The system of claim 1, wherein the one or more controllers are configured to provide at least approximately 125 kilowatts of power to the second coil.

7. The system of claim 1, further comprising a pyrometer coupled to the one or more controllers and configured to measure temperature of the tubular; wherein the one or more controllers are configured to determine a level of current to provide to at least one of the first coil and the second coil based on temperature measurement values received from the pyrometer.

8. The system of claim 1, wherein the one or more controllers comprise at least one processor and a computer-readable storage, wherein the one or more controllers are configured to:

store, for each of a plurality of different tubulars, in the computer-readable storage:

a heat treatment temperature value, and a heat treatment time; and cause the first and second coils to heat treat each of the different tubulars in accordance with the temperature and treatment time values stored for the tubular.

9. An inductive heat treatment apparatus, comprising:

an exterior induction coil configured to surround an outside diameter of a tubular;

an interior induction coil configured to occupy a bore of the tubular in alignment with the exterior induction coil; and one or more controllers coupled to the exterior induction coil and the interior induction coil; wherein the one or more controllers are configured to simultaneously energize the exterior induction coil and the interior induction coil to concurrently heat treat a selected cylindrical portion of the tubular from exterior and interior of the tubular, wherein the one or more controllers are configured to provide alternating current to energize the exterior induction coil and the interior induction coil; wherein the frequency of the alternating current provided to the exterior induction coil has a frequency that is lower than the frequency of alternating current provided to energize the interior induction coil.

10. The inductive heat treatment apparatus of claim 9, wherein the one or more controllers are configured to:

provide alternating current to the exterior induction coil at a frequency of approximately 180 hertz; and provide alternating current to the interior induction coil at a frequency in a range of approximately 3 kilohertz to approximately 10 kilohertz.

11. The inductive heat treatment apparatus of claim 9, wherein the one or more controllers are configured to:

provide at least approximately 150 kilowatts of power to the exterior induction coil; and provide at least approximately 125 kilowatts of power to the interior induction coil.

12. The inductive heat treatment apparatus of claim 9, further comprising a pyrometer coupled to the one or more controllers and configured to measure temperature of the tubular during heat treatment; wherein the one or more controllers is configured to provide alternating current to at least one of the exterior induction coil and the interior induction coil based on temperature measurement values received from the pyrometer.

13. The inductive heat treatment apparatus of claim 9, wherein the one or more controllers comprise at least one processor and a computer-readable storage, wherein the one or more controllers are configured to:

store for each of a plurality of different tubulars:

a heat treatment temperature value, and a heat treatment time; and cause the interior induction coil and the exterior induction coil to heat treat each of the different tubulars in accordance with the values stored for the tubular.

14. The inductive heat treatment apparatus of claim 9, wherein the one or more controllers are configured to produce a heat affected zone having a parabolic outline that faces away from a weld line in a heat treated wall of the tubular.

* * * * *